United States Patent [19]

Kunii et al.

[11] 4,280,214

[45] Jul. 21, 1981

[54] WRIST WATCH

[76] Inventors: Shusaku Kunii, 39-36, Nishishinjuku 4-chome, Shinjuku-ku, Tokyo; Hitoshi Hirano, 2485, Sakaecho, Kodaira-shi, Tokyo, both of Japan

[21] Appl. No.: 962,972

[22] Filed: Nov. 22, 1978

[30] Foreign Application Priority Data

Nov. 28, 1977 [JP] Japan ..... 52-159425[U]

[51] Int. Cl.[3] ..... G04B 37/00

[52] U.S. Cl. ..... 368/282; 368/281; 368/293

[58] Field of Search ..... 224/4 R–4 K; 58/23 R, 2 BA, 50 R, 85.5, 88 R, 88 SC, 106.5; 128/1, 3; 368/281, 282, 293

[56] References Cited

U.S. PATENT DOCUMENTS

| | | | |
|---|---|---|---|
| 403,211 | 5/1889 | Pratt | 58/106.5 |
| 3,759,031 | 9/1973 | McCullough et al. | 58/23 R X |
| 4,008,566 | 2/1977 | McClintock | 58/50 R |
| 4,043,116 | 8/1977 | Schlappi | 58/127 R X |

*Primary Examiner*—Ulysses Weldon

*Attorney, Agent, or Firm*—Blanchard, Flynn, Thiel, Boutell & Tanis

[57] ABSTRACT

A wrist watch having healthful and remedical effects. The wrist watch is composed of a digital watch body and a watch band which is attached to the watch body, and at least one of the watch body and watch band is magnetized. The magnetization is done by making the component parts of a magnetic material or by inlaying a plurality of magnetic substances into the component parts.

5 Claims, 9 Drawing Figures

WRIST WATCH

BACKGROUND OF THE INVENTION (1) Field of the Invention

This invention relates to a wrist watch comprising a digital watch body and a watch band. More particularly, the invention relates to an improved digital wrist watch in which one member or both of the watch body and the watch band are magnetized for exercising healthful and remedical effects upon the user thereof.

(2) Description of the Prior Art

There are hitherto known magnetic rings, magnetic necklaces and magnetic bracelets as healthy and remedical goods utilizing magnetism. In the conventional art, however, there has never been a wrist watch having such function. This is due to the fact that, in the conventional wrist watches, time is indicated generally by driving hands and many assembled gears with the power source of mainsprings. Accordingly, when wrist watches are placed in the magnetic field, the regularity of watches are impaired by magnetic force and they lose their essential functions.

Meanwhile, in view of the fact that recently developed digital watches are free from the influence of magnetism, the inventors of the present application have accomplished this invention.

BRIEF SUMMARY OF THE INVENTION

It is, therefore, the primary object of the present invention to provide a wrist watch which has the healthful and remedical effects without losing its inherent function as a timekeeper.

Another object of the present invention is to provide a novel wrist watch in which at least some of its component parts are magnetized so as to exert the healthful and remedical effects upon the user of the watch.

A further object of the present invention is to provide a wrist watch having the above-mentioned effects which is produced without difficulty and used for a long time.

In accordance with the present invention, the wrist watch is composed of a watch body and a watch band, and one or both of them are magnetized.

BRIEF DESCRIPTION OF THE DRAWINGS

These and other objects and features of the invention will become more apparent from the following description taken in connection with the accompanying drawings in which.

DESCRIPTION OF PREFERRED EMBODIMENTS

Referring now to the accompanying drawings, the embodiments of the present invention will be described in more detail.

As shown in FIGS. 1 to 5, a first embodiment of the present invention comprises a digital watch body 1 and a watch band 2 which is fixed to the watch body 1. In the watch body 1, as known in the prior art, the oscillation pulses of a crystal oscillator are detected and the time is digitally indicated with luminous diodes. The crystal itself in the digital watch body 1 is not affected by the magnetic field so that the oscillation of the crystal oscillator is free from the influence of magnetic force. Further, the electric circuit to receive and calculate the oscillation pulses of the crystal oscillator is not adversely affected by the magnetic field. Therefore, the digital wrist watch 1 does not lose its function even when it is placed in magnetic field.

Figure 1:
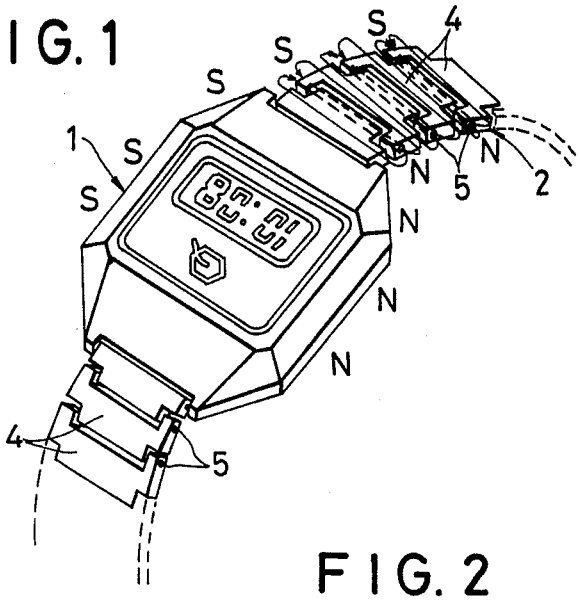
FIG. 1 is a perspective view of an embodiment of the present invention.
Figure 3:
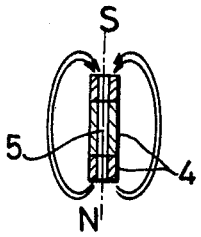
FIG. 3 is a cross-sectional view taken on the line III—III in FIG. 2.
Figure 2:
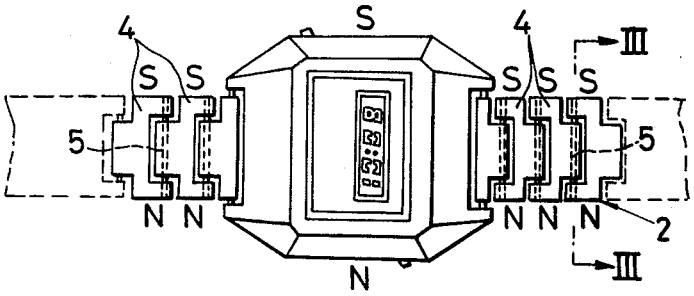
FIG. 2 is a plan view of the embodiment shown in FIG. 1.
Figure 4:
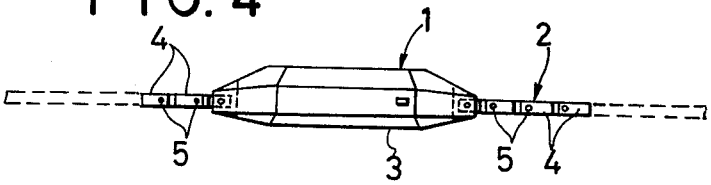
FIG. 4 is a side view of the above embodiment.
Figure 5:
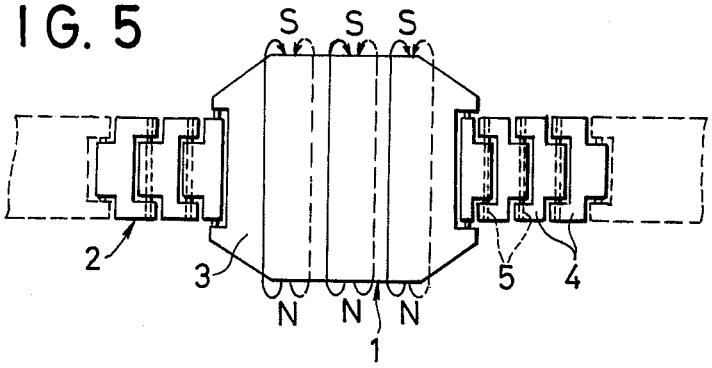
FIG. 5 is a rear view of the above embodiment.

The rear cover 3 of the watch body 1 is made of a magnetic material such as iron, nickel, ferrite and cobalt. As shown in FIG. 5, the rear cover 3 is magnetized so as to produce a plurality of magnetic fields in the direction at right angles to the length of the watch band 2. The watch band 2 is composed of a plurality of metallic parts 4 which are linked together by means of connecting pins 5. The above connecting pins 5 are made of a magnetic material and they are magnetized so as to have the magnetic fields in the same direction as those of the above rear cover 2.

Figure 6:
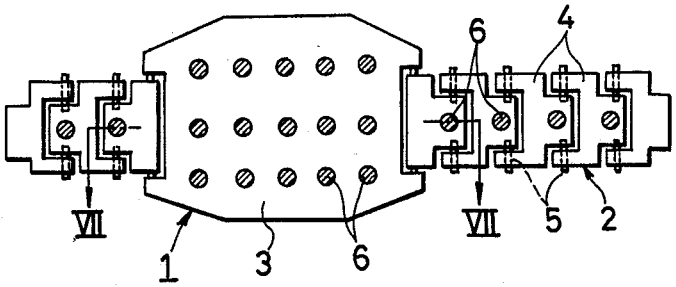
FIG. 6 is a rear view of another embodiment of the present invention.
Figure 7:
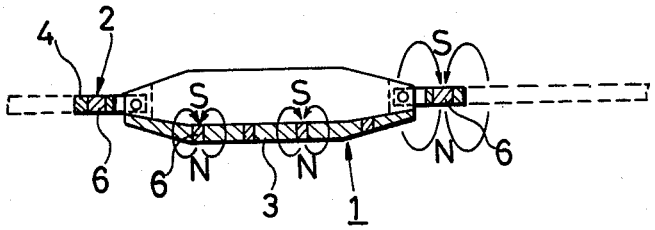
FIG. 7 is a cross-sectional view taken on the line VII—VII in FIG. 6.

Another embodiment of the present invention is shown in FIGS. 6 and 7, in which the rear cover 2 of the watch body 1 and the respective metallic parts 4 of the watch band 2 are inlaid with magnetic substances 6 made of a magnetic material. Each magnetic substance 6 is magnetized in the same direction of the thicknesses of the rear cover 3 and the metallic parts 4. In this case, the inside of the rear cover 3 may be applied with a magnetic sheet or plate by adhesion.

Figure 8:
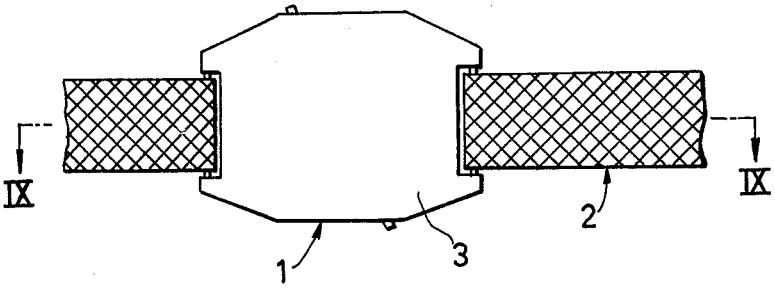
FIG. 8 is a rear view of a further embodiment of the present invention.
Figure 9:
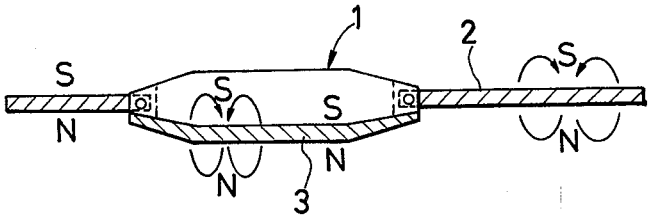
FIG. 9 is a cross-sectional view taken on the line IX—IX in FIG. 8.

Still another embodiment of the present invention is shown in FIGS. 8 and 9. The watch band 2 that is attached to the watch body 1 is made of a magnetic material and has a network structure. The rear cover 3 of the watch body 1 is also made of a magnetic material and both the watch band 2 and the rear cover 3 are magnetized in the same direction of the thicknesses of them.

Further, in the above embodiments, when the metallic parts 4 are made of a magnetic material, they can be magnetized directly. When the rear side of the watch body 1 is covered by the watch band 2, it is not necessary to magnetize the watch body 1. Furthermore, when the watch band 2 is made of leather or cloth which is not suitable to be magnetized or applied with magnetic substances, the watch body itself may be magnetized. Any way, the purpose of the present invention can be attained if one or both of the watch body and the watch band are magnetized.

As described above, the wrist watch which is put on the arm in order to know time, is magnetized in the present invention. Therefore, when the wrist watch is worn for its own purpose, it serves simultaneously as a healthy and remedical good. Further, the wrist watch of the present invention gives little decorative appearance so that it gives no reluctant feeling to any person.

Lastly, it should be emphasized that the specific embodiments described and shown herein are intended as merely illustrative and in no way restrictive of the invention.

What is claimed is:

1. In a wrist watch comprising a watch apparatus, of a type operable independent of magnetic fields, for keeping and indicating the time;

a hollow watch body housing said watch apparatus therewithin and having a rear cover for facing the wrist of the wearer;

a watch band attached to said watch body for securing the watch to the wrist of the wearer such that said rear cover and band engage and circumferentially surround said wrist;

the improvement comprised in that the watch apparatus is of a conventional digital type capable of operation in a magnetic field;

at least one of said rear cover and watch band incorporating, in operatively fixed location thereon, portions of magnetizable material magnetized to form permanent magnets each having an N-pole and an S-pole, said magnetized material being distributed substantially over the whole circumferential width of said at least one of said rear cover and watch band, there being more than one said permanent magnet, adjacent said permanent magnets lying with their lengths substantially parallel, all of said permanent magnets having their magnetic fields aimed in the same direction and substantially perpendicular to the circumferential direction of said rear cover and watch band, the N-pole of each said permanent magnet being spaced from and free of contact with the S-pole of any other said permanent magnet, said rear cover and watch band being free of closed magnetic circuits through magnetizable material from the N-pole of any permanent magnet to the S-pole of the same permanent magnet, the array of said permanent magnets covering a portion of the wrist of the wearer, which portion has a circumferential width at least as great as the circumferential width of said rear cover.

2. The apparatus of claim 1 in which both of said rear cover and watch band include at least one of said permanent magnets.

3. The apparatus of claim 2 in which said rear cover is a magnetic material member magnetized to form a plurality of said permanent magnets arranged side-by-side along the circumferential direction of said rear cover and watch band, the length dimension of said permanent magnets extending in the plane of said rear cover with the N-poles thereof and S-poles thereof at opposite side edges of said rear cover, said watch band comprising a plurality of circumferentially distributed metallic parts linked together by connecting pins, said connecting pins being circumferentially spaced from each other along said watch band and extending the width of said watch band, each of said pins comprising a said permanent magnet oriented parallel to the permanent magnets in said rear cover and with said N-poles of said connecting pins and N-poles of said rear cover lying at the same edge of said rear cover and watch band.

4. The apparatus of claim 2 in which said rear cover and circumferentially spaced portions of said watch band are inlaid with permanent magnets, there being a plurality of said permanent magnets distributed circumferentially on said rear cover, said permanent magnets of said rear cover and watch band being oriented with their length dimensions perpendicular to the plane of said rear cover and watch band so that the same pole of all of said permanent magnets faces the wrist of the wearer.

5. The apparatus of claim 2 in which said rear cover and watch band are of magnetized material, each magnetized in the direction of the thickness thereof and with only one polarity of magnetic pole facing toward the wrist of the wearer.

* * * * *